US006485326B1

(12) United States Patent
Trainor et al.

(10) Patent No.: US 6,485,326 B1
(45) Date of Patent: Nov. 26, 2002

(54) HIGH-VOLTAGE CONNECTION ENCLOSURE AND METHOD

(75) Inventors: Terry J. Trainor, Erin, TN (US); Alan M. Smith, Dickson, TN (US); Mary J. Springer, Centerville, TN (US)

(73) Assignee: France/Scott Fetzer Company, Fairview, TN (US)

( * ) Notice: Subject to any disclaimer, the term of this patent is extended or adjusted under 35 U.S.C. 154(b) by 40 days.

(21) Appl. No.: 09/692,560

(22) Filed: Oct. 19, 2000

(51) Int. Cl.[7] ..... H01R 13/60
(52) U.S. Cl. ..... 439/527; 439/934; 174/91
(58) Field of Search ..... 439/472, 527, 439/460, 892, 934; 174/85, 87, 91, 93

(56) References Cited

U.S. PATENT DOCUMENTS

| | | | | | |
|---|---|---|---|---|---|
| 3,557,299 | A | * | 1/1971 | Dienes | 174/38 |
| 3,806,630 | A | * | 4/1974 | Thompson et al. | 174/72 R |
| 3,848,074 | A | * | 11/1974 | Channell | 174/38 |
| 3,941,928 | A | | 3/1976 | Gaind | |
| 3,977,750 | A | | 8/1976 | Glover et al. | |
| 4,053,704 | A | * | 10/1977 | Smith | 174/87 |
| 4,079,189 | A | | 3/1978 | Troccoli | |
| 4,333,702 | A | | 6/1982 | Herrmann, Jr. | |
| 4,427,256 | A | | 1/1984 | Reif et al. | |
| 4,455,056 | A | | 6/1984 | Herrmann, Jr. et al. | |
| 4,554,401 | A | * | 11/1985 | Ball | 174/37 |
| 4,605,272 | A | | 8/1986 | Myers et al. | |
| 4,865,559 | A | | 9/1989 | Clabburn | |
| 4,953,314 | A | | 9/1990 | Moulton | |
| 5,022,874 | A | | 6/1991 | Lostumo | |
| 5,055,636 | A | * | 10/1991 | Jaycox | 174/87 |
| 5,155,303 | A | * | 10/1992 | Bensel, III et al. | 174/93 |
| 5,211,587 | A | | 5/1993 | Alden | |
| 5,232,376 | A | | 8/1993 | Wen | |
| 5,252,779 | A | * | 10/1993 | DiRienzo | 174/87 |
| 5,427,270 | A | * | 6/1995 | Patterson | 220/250 |
| 5,580,266 | A | | 12/1996 | Shelly | |
| 5,591,049 | A | | 1/1997 | Dohnishi | |
| 5,626,486 | A | | 5/1997 | Shelly et al. | |
| 5,876,229 | A | | 3/1999 | Negle | |
| 5,947,758 | A | | 9/1999 | Enck | |
| 6,051,791 | A | * | 4/2000 | King | 174/87 |

OTHER PUBLICATIONS

Masters Technology, Inc., *High Voltage Splice Box*, Product Description Sheet (1 sheet) No date.
Electrobits Sign Systems Inc., *Connection Products*, Web Site, pp. 1–2 No date.
Photograph of Commercially Available Product, 1 page No date.

* cited by examiner

*Primary Examiner*—Brian Sircus
*Assistant Examiner*—Thanh-Tam Le
(74) *Attorney, Agent, or Firm*—Wood, Herron & Evans, L.L.P.

(57) ABSTRACT

An enclosure for an electrical connection between two high-voltage cables that includes an electrically nonconductive separator integral with a mounting base for receiving the high-voltage cables. An electrically nonconductive tubular cover extends over the electrical connection and the high-voltage cables and is releasably attached to the base. The separator has at least two resiliently mounted fingers, and the electrically nonconductive cover extends over the fingers to depress and move the fingers into contact with the high-voltage cables, thereby securing the high-voltage cables in the mounting base. The high-voltage cables are extended beyond the mounting base a distance equal to a desired spacing separating the electrical connection between the high-voltage cables and an electrical conductor associated with the mounting base. The tubular cover is transparent so that the electrical connection joining the high-voltage cables can be visually inspected through the cover.

35 Claims, 3 Drawing Sheets

HIGH-VOLTAGE CONNECTION ENCLOSURE AND METHOD

FIELD OF THE INVENTION

The present invention generally relates to an high-voltage connection enclosure and more particularly, to an improved enclosure for connecting high-voltage cables connected to high-voltage gas-filled tubes, for example, neon tubes used for signage.

BACKGROUND OF THE INVENTION

High-voltage, gas-filled tubes have been widely used for signage for decades. Some neon signage has the gas-filled tubes depicting letters and numbers completely enclosed in a housing that protects the electrical components and electrical connections from the weather. With other sign constructions, the sign is composed of individual gas-filled tubes representing letters and numbers that are individually mounted to an exterior wall or other surface of a structure without the benefit of an enclosure over all of the components. In that construction, the individual gas-filled tubes must be wired together in a high-voltage circuit that is powered from a secondary winding of a transformer. In a known manner, the wire from a gas-filled neon tube has an electrode that is connected to a conductor or wire, for example, a high-voltage gaseous tube and oil ignition ("GTO") cable. In many applications, the electrical connection between the neon tube electrode and one end of the high-voltage GTO cable is accomplished utilizing a known connector P-K connector. The other end of the GTO cable is then connected to either one side of the secondary winding of the transformer or an electrode of an adjacent gas-filled neon tube. Thus, the gas-filled neon tubes are connected in series with the secondary winding of the transformer. In some applications, a single GTO cable is connected to adjacent gas-filled tubes. While such a connection would seem to be efficient, since the PK connectors are often located within a wall of the structure, the diagnosis and correction of a fault is time consuming and difficult. In other applications, a GTO cable from one gas-filled tube is connected or spliced with a GTO cable from an adjacent gas-filled tube in a junction box. Such known junction boxes have at least one electrically conductive terminal to which the ends of both GTO cables are mechanically connected and secured, thereby electrically connecting the GTO cables together. Other terminal boxes have two electrically conductive terminals connected with a electrically conductive bar, and an end of each of the GTO cables is attached to one of the terminals.

Such junction boxes permit gas-filled neon tubes to be very easily connected together. In some applications, the P-K connectors extend through the exterior wall of a building; and the junction boxes are in a relatively protected environment. In other applications, the P-K connectors and the junction boxes are mounted on the exterior wall of the building, and thus, must be impervious to harsh weather conditions.

Of significant concern is the potential for arcing or a short circuit between the exposed ends of the GTO cable and any grounded metal component within the junction box. To minimize the potential for arcing within the junction box, regulations are implemented setting forth a minimum distance between a cable connection and a metal portion of the junction box. Over the years, the specified minimum distance has increased, and more recent regulations may require different minimum distances depending on whether the junction box is located inside or outside a structure. Operating in an environment in which the regulations constantly change is a particular challenge with respect to the junction box design.

Further, there is a continuing requirement to make junction boxes more reliable and easier to use. For example, some junction box designs have various loose parts that must be assembled in the process of splicing two cables together. Further, after the cable splice is made and the junction box is permanently mounted, all junction boxes are opaque; and therefore, the junction box must be opened or partially disassembled to check the integrity of the splice.

Therefore, there is a need for an improved enclosure for connecting the ends of high-voltage GTO cables that can be readily changed to meet regulations that are constantly changing. Further, there is a need for a junction box that permits the integrity of the splice to be checked without having to disassemble the junction box. Further, there is a need for a junction box design that is easier to handle in the connecting of the GTO cables.

SUMMARY OF INVENTION

The present invention provides a high-voltage connection enclosure that is less susceptible to arcing and short circuits that may potentially result in a fire. The enclosure of the present invention is easy to use and permits a visual inspection of the electrical connection between two GTO cables without having to remove a cover or in any way disassemble the enclosure. Further, the enclosure of the present invention automatically secures the GTO cables in the enclosure as an enclosure cover is attached. Thus, the present invention provides a more consistent, reliable and higher quality, high-voltage electrical connection between ends of GTO cables. The invention is especially useful in providing an electrical connection with a high-voltage, gas-filled tube used for signage in which the electrical connection is exposed to a wide range of temperature and moisture conditions.

In accordance with the principles of the present invention and the described embodiments, an apparatus is provided for enclosing an electrical connection between two high-voltage cables. The apparatus has an electrically nonconductive separator integral with a mounting base for receiving the high-voltage cables. An electrically nonconductive tubular cover extends over the electrical connection and the high-voltage cables and is releasably attached to the mounting base.

In one aspect of the invention, the separator has two passages in a base portion to separately receive the high-voltage cables. The high-voltage cables are extended beyond the mounting base, so that the electrical connection is separated from an electrically conductive portion of the mounting base by a desired spacing. The separator also has fingers that are moved by the tubular cover into contact with the high-voltage cables to secure the high-voltage cables in the separator.

In a still further aspect of the invention the electrically nonconductive cover is sufficiently transparent so that the electrical connection joining the high-voltage cables can be visually inspected through the cover.

In another embodiment, the present invention includes a method of electrically connecting two high-voltage cables by first inserting each of the high-voltage cables into a separate passage formed of a nonconductive material integral with a mounting base. Next the high-voltage cables are extended a distance beyond the mounting base equal to a desired separation between an electrical connection between the cables and an electrical conductor associated with the mounting base. The ends of the high-voltage cables are joined together to form the electrical connection; and then, an electrically nonconductive tubular cover is placed over the electrical connection and the high voltage cables and is releasably attached to the mounting base.

In an aspect of that invention, the method further comprises securing the high-voltage cables in the mounting base.

Various additional advantages, objects and features of the invention will become more readily apparent to those of ordinary skill in the art upon consideration of the following detailed description of the presently described embodiments taken in conjunction with the accompanying drawings.

DETAILED DESCRIPTION OF THE INVENTION

Figure 1:
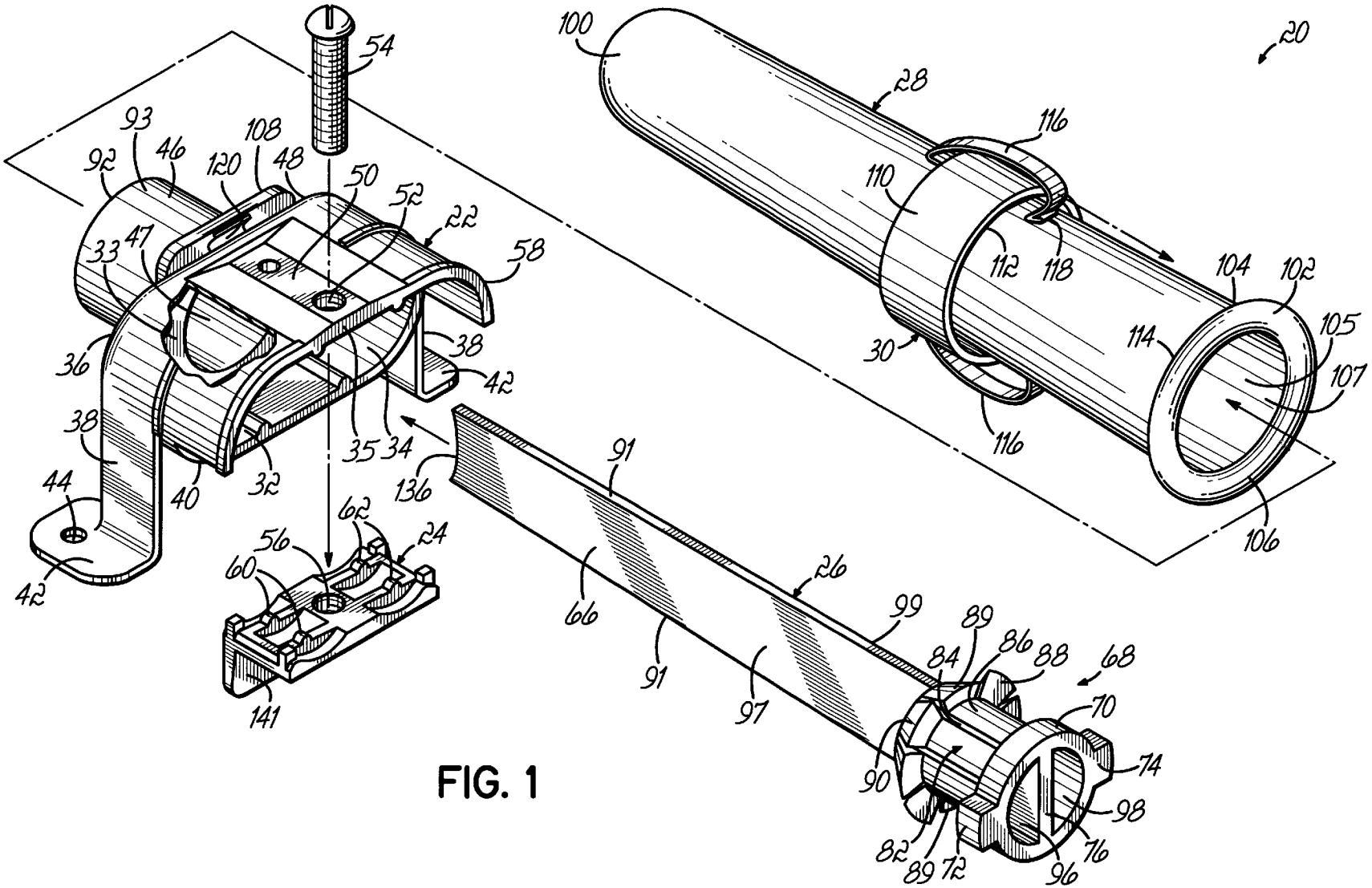
FIG. 1 is a disassembled perspective view of a high-voltage connection enclosure in accordance with the principles of the present invention.

Referring to FIG. 1, the high-voltage connection enclosure 20 is comprised of a mounting base 22, a mounting base bracket 24, a separator 26, a cover or tubular body 28 and a tube clamp 30. The mounting base 22 has two opposed cavities 32, 34 that have generally circular outer wall portions that are sized to receive flexible metal cable that is typically used. The cavities 32, 34 have a depth that permit the metal flexible conduit to be inserted until it hits a rear surface 33 of a top wall 36 of the mounting base 22. Mounting legs 38 extend laterally away from the rear side 40 of the mounting base 22 and have mounting feet 42 formed on their distal ends. The mounting feet 42 have through holes 44 that accept fasteners for attaching the mounting base 22 to a surface. A hollow cylindrical tube mount 46 extends from the top 48 of the mounting base 22. The tube mount 46 is equally spaced between the cavities 32, 34, and the tube mount 46 has a cylindrical through bore 47 intersecting the cavities 32, 34. The front side 50 of the mounting base 22 has a clearance hole 52 for receiving a fastener 54 that threadedly engages a hole 56 within the bracket 24. The cavities 32, 34 have an extension or hood 58 on the front side 50 of the mounting base 22. The mounting base bracket 24 is located immediately below the extension 58 and has ears 60, 62 for engaging and locking into grooves in the metal flexible conduit disposed in the respective cavities 32, 34.

The separator 26 has a spacer wall 66 extending from a base portion 68. The separator 26 is located in the mounting base 22 and through the tube mount 46 at an orientation such that the spacer wall 66 is substantially perpendicular to a line joining the centers of the cavities 32, 34. In other words, the spacer wall 66 bisects the internal bore 47 of the tube mount 46 along a diameter bisecting the top and bottom sides 50, 40, respectively, of the mounting base 22. The base 68 of the separator 26 has a retaining flange or lip 70 with diametrically opposed locating tabs 72, 74. The spacer wall 66 extends through the base 68 and has a bottom end 76 formed with the retaining lip 70. A segmented bushing 82 is formed with the retaining lip 70 and has a plurality of through slots 84 between segments 86 to permit radially inward motion of the segments 86 during the mounting of the separator 26 within the mounting base 22. A plurality of locking teeth or fingers 88 are formed on an inner end of the segmented bushing 82. The plurality of fingers 88 are cantilevered from the retaining ring 70, and each of the fingers 88 along with a corresponding bushing segment 86 is resiliently, pivotable with respect to the retaining ring 70. Therefore, the fingers 88 are independently movable in a generally radial direction with respect to the generally cylindrical bushing 82. The slots 84 extend between the locking fingers 88 to facilitate a radially inward deformation of the locking fingers 88 in the assembly process.

Figure 2:
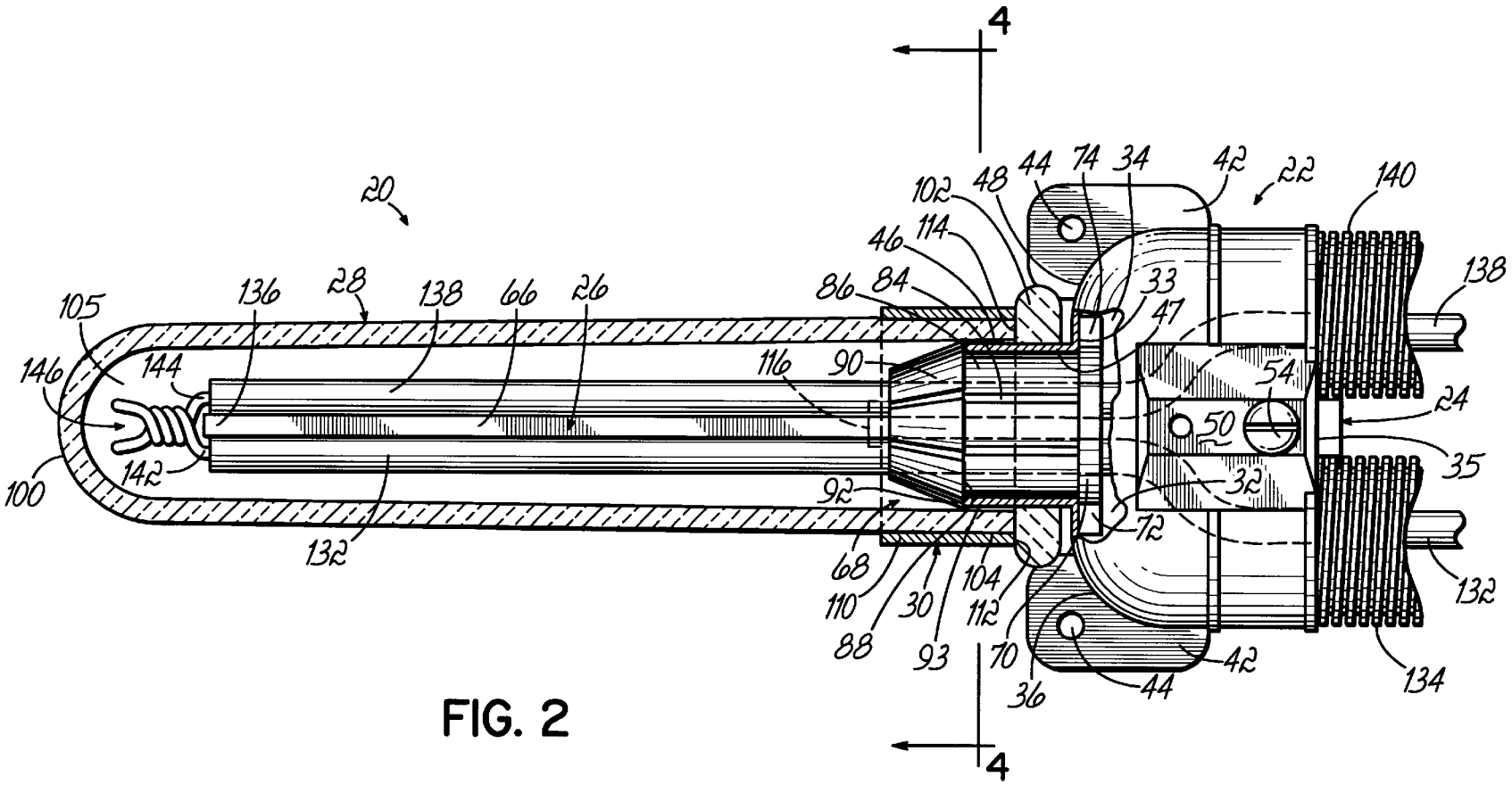
FIG. 2 is a top view of the assembled high-voltage connection enclosure illustrated in FIG. 1.

To assemble the separator 26 in the mounting base 22, the spacer wall 66 is inserted into the bore 47 of the tube mount 46 from the mounting base bottom side 35. Upon the fingers 88 contacting an edge of the bore 47 of the tube mount 46, angled surfaces 90 of the fingers 88 facilitate compression of the fingers in response to an axial force being applied against the bottom surface 76 of the retaining lip 70. As the plurality of fingers 88 and bushing segments 82 move radially inward, the plurality of fingers 88 slide through the bore 47 of the tube mount 46. As shown in FIG. 1, two opposed projections 89 are aligned with and extend radially from opposite edges 91 of the spacer wall 66. The projections 89 are radially smaller than the fingers 88 and normally pass through the bore 47 without contacting the walls of the bore 47. The axial length of the segmented bushing 82 is slightly larger than the axial length of the tube mount 46 (FIG. 2). Therefore, as the locating tabs 72, 74 contact the inside surface 33 of the front wall 36, the plurality of fingers 88 pass the top edge 92 of the tube mount 46 and expand radially outward. The top edge 92 of the tube mount 46 locks behind the plurality of fingers 88, thereby permanently locking the separator 26 into the mounting base 22 and forming an integral unit therewith. The fingers 88 have a length such that they extend radially beyond a cylindrical outer surface 93 of the tube mount 46. Referring to FIG. 1, the ends of the tabs 72, 74 are sized to contact an inner, generally spherically shaped portion of the front wall 36 of the mounting base 22, thereby preventing the separator 26 from rotating within the mounting base 22.

The tubular body or tube 28 has a closed end 100 and an annular flange 102 at its opposite open end 104. The tube 28 has an inner, generally cylindrical cavity 105 with a diameter that is slightly larger than the outer diameter of the tube mount 46. However, the diameter of the cavity 105 is slightly smaller than a diameter extending across the fingers 88. The spacer wall 66 of the separator 26 as assembled in the mounting base 22 extends outward from the tube mount 46. After electrically connecting the GTO cables as will be described, the assembly of the high-voltage connection enclosure 20 is completed by sliding the tube 28 over the separator 26, over the fingers 88 and securing the tube 28 against the mounting base 22 with a tube clamp 30. Thus, the tube 28 completely encloses the spacer wall 66 and depresses the fingers 88 slightly radially inward. The tube clamp 30 has a cylindrical tubular body 110 that slides over an outer, generally cylindrical surface of the tube 28. The tube clamp body 110 has an annular bottom edge 112 that contacts an annular top surface 114 of the flange 102 of the tube 28. The tube clamp 30 also has two diametrically opposed spring arms or clips 116 that are pressed together to cause the arms to extend, thereby permitting ends 118 of the arms 116 to be located in notches 120, thereby securing the tube 28 to the mounting base 22. The fully assembled high-voltage connection enclosure 20 is shown in FIG. 2.

Referring again to FIG. 1, the spacer wall 66 extends through and generally bisects the segmented bushing 82 and the retaining lip 70 to form two generally semicircular passages or through holes 96, 98. Passage 96 extends through the retaining lip 70 and the segmented bushing 82 of the base 68 and opens to one side 97 of the spacer wall 66. Passage 98 similarly extends through the retaining lip 70 and the segmented bushing 82 of the base 68 and opens to an opposite side 99 of the spacer wall 66.

The mounting base 22 and bracket 24 are normally made from an electrically conductive material, for example, a cast zinc. The electrically conductive material is chosen for reasons of cost and physical strength. The separator 26 is normally made from an electrically nonconductive material, for example, a "LEXAN" 503 plastic material; however as will be appreciated other electrically nonconductive materials may be used. The tubular body 28 is also made from an electrically nonconductive material, for example, a clear or transparent glass; but as will be appreciated, other electrically nonconductive materials may be used.

Figure 3:
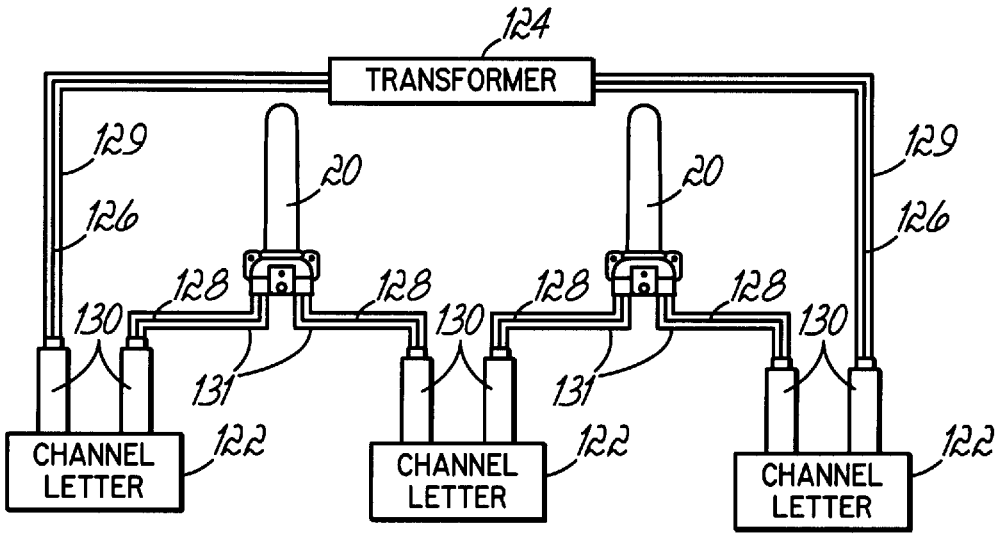
FIG. 3 is a schematic block diagram of a circuit illustrating the use of the high-voltage connection enclosure illustrated in FIG. 1.

In use, referring to FIG. 3, the high-voltage connection enclosures 20 are typically used in a serial circuit with high-voltage, gas-filled tubes 122, for example, neon tubes. Each end of the gas-filled tubes 122 has an electrode that is connected to a GTO cable 126, 128 inside a PK connector 130. The gas-filled tubes 122 are wired together in a serial circuit that is powered from a secondary winding from a transformer 124. Thus, the first and last gas-filled tubes 122 have one electrode connected to first ends of GTO cables 126. In a known manner, the GTO cables 126 are normally routed through sections of conduit 129, for example, a flexible metal conduit; and the opposite ends of the GTO cables 126 are connected to a secondary winding of a transformer 124. The other electrodes of the gas-filled tubes 122 are connected via GTO cables 128 that are routed in respective sections of conduit 131 and connected together in a junction box, for example, the high-voltage connection enclosure 20.

Figure 4:
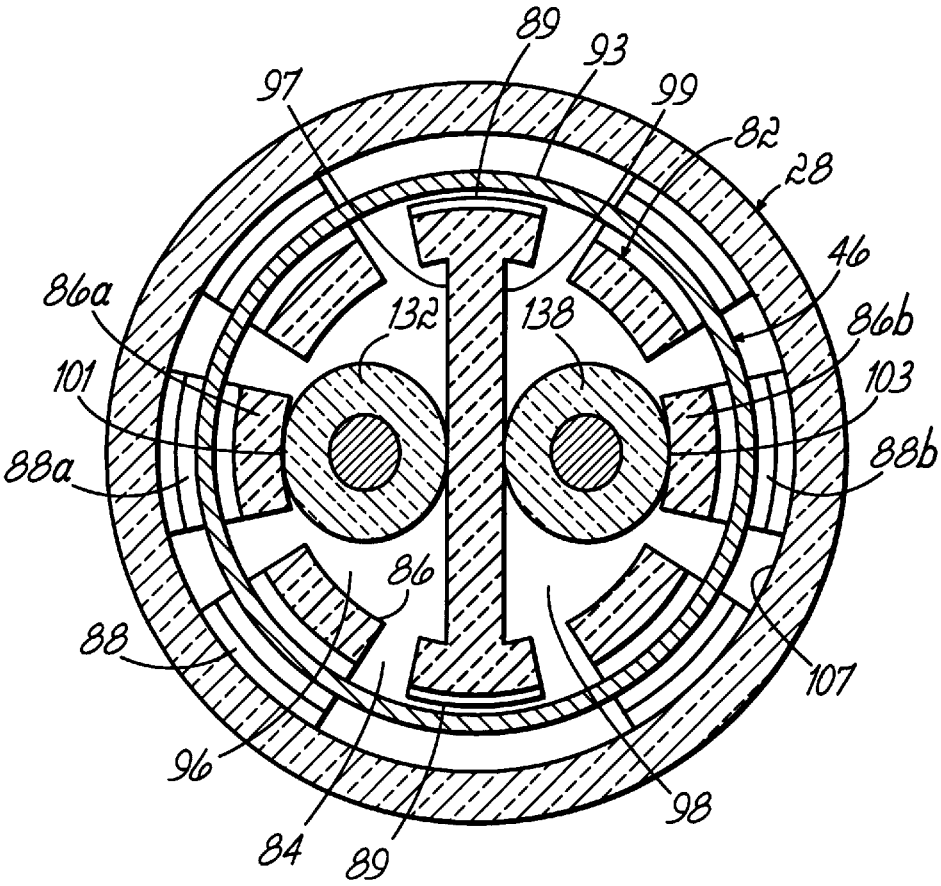
FIG. 4 is an enlarged cross-sectional view taken along line 4—4 of FIG. 2 and illustrates the locking of GTO cables in the high-voltage connection enclosure illustrated in FIG. 1.

In making an electrical connection or a splice, the tube clamp 30 is disengaged; and the tube clamp 30 and tube 28 are removed from the mounting base 22. Further, the fastener 54 is loosened to loosen the mounting base bracket 24. Referring to FIGS. 1 and 2, a length of GTO cable 132 extending from the end of one of the metallic flexible conduits 134 is inserted into the cavity 32 through the first passage 96 and along the one side 97 of the spacer wall 66. A length of the GTO cable 132 should extend beyond the distal end 136 of the spacer wall 66. In a similar manner, a second GTO cable 138 extending from the end of a metallic flexible conduit 140 is threaded through the cavity 34, the second passage 98 and along the opposite side 99 of the spacer wall 66. Again, a length of GTO cable 138 should extend beyond the distal end 136 of the spacer wall 66. Referring to FIG. 4, it should be noted that the cavities 96, 98 are nominally sized such that the outer surfaces of the GTO cables 132, 138 just touch the respective opposite sides 97, 99 of the spacer wall 66 and the respective opposed inner surfaces 101, 103 of the respective fingers 88*a*, 88*b*. Referring to FIG. 2, the conduits 134, 140 are then inserted in the respective cavities 32, 34, and the fastener 54 is tightened, Tightening the fastener 54 clamps the mounting base bracket 24 tightly against the conduits 134, 140. The ears 60, 62 on the bracket 24 engage or penetrate an external feature of the conduits 134, 140, thereby more firmly securing the conduits to the mounting base 22. For example, if the conduits 134, 140 are metal flexible conduits, the ears 60, 62 lock into helical grooves extending over an exterior surface of the metal conduits 134, 140. As the fastener 54 is tightened and the mounting base bracket brought up against the conduits 134, 140, a rearward extending flange or cover 141 of the bracket 24 functions to cover the cavities 32, 34. The ends of the respective GTO cables 132, 138 extending beyond the distal end 136 of the spacer wall 66 are stripped to bear respective conductors or wires 142, 144. The wires 142, 144 are twisted together or otherwise joined with an electrical connector to form a high-voltage electrical connection 146 beyond the distal end 136 of the spacer wall 66.

Thus, the separator 26 performs several functions. First, the openings 96, 98 provide paths for the GTO cables through the mounting base 22 that protect the cables from scuffing or physical damage from any edges or other physical features of the mounting base 22. Further, the separator spacer wall 66 has a length that guarantees a spacing or separation between the high-voltage electrical connection 146 and any metal components, for example, the front wall 36 of the mounting base 22. That separation or spacing is often determined by UL regulations. Further, different spacing or separations are readily obtained by simply changing the length of the spacer wall 66 and the tube 28. In addition, the spacer wall 66 provides mechanical support for the high-voltage connection 146 immediately adjacent its distal end 136.

After the high-voltage electrical connection 146 is made, the clear tubular body 28 is slid over the connection 146, the GTO cables 132, 138, spacer wall 66 and the fingers 88. The inner diameter of the cavity 105 of the tubular body 28 is slightly smaller than a diameter extending across the fingers 88. Therefore, referring to FIG. 4, as the cylindrical inner surface 107 of the tubular body 28 is slid over the fingers 88, the fingers 88 are deflected or forced radially inward. A lower corner or edge surface 101 at the intersection of the tooth 88*a* with its corresponding segment 86*a* is pushed into the outer surface of the cable 132. That deflection of the tooth 88*a* and segment 86*a* functions to lock the cable in the cavity 96 and resists forces on the cable 132 occurring in a direction toward the viewer of FIG. 4. A lower corner or edge surface 103 at the intersection of the tooth 88b with its corresponding segment 86*b* is pushed into the outer surface of the cable 138, thereby locking the cable 138 in the cavity 98.

Upon sliding the tubular body 28 over the fingers 88, the bottom surface 106 on flange 102 of the tubular body 28 contacts a forward surface 108 on the mounting base 22. Thereafter, the cylindrical body 110 of the tube clamp 30 is slid over the tubular body 28 until the bottom edge 112 of the cylindrical body 110 contacts an upper annular surface 114 of the flange 102. The spring arms 116 are then manually compressed until the arm ends 118 slide into the locking notches 120. Upon releasing the spring arms 116, the ends 118 of the spring arms 116 are secured in the notches 120, thereby securing the tubular body 28 to the mounting base 22. If not already permanently mounted, the mounting base is then mounted on a wall with the clear tubular body pointing in the vertically upward direction.

The high-voltage connection enclosure 20 provides a connection enclosure for interconnecting high-voltage, gas-filled tubes that is less susceptible to arcing and short circuits which may lead to a fire when exposed to a wide range of temperature and moisture conditions. With the high-voltage connection enclosure described herein, the separator 26 is fixed in the mounting base 22; and therefore, routing the GTO cables and making the electrical connection is very easy. Further, the clear glass tubular cover not only provides superior, long term electrical insulating capability, but the clear cover permits an immediate visual inspection of the electrical connection without having to remove a cover or disassemble the enclosure in any way. Being able to quickly determine the mechanical integrity of the electrical connection makes diagnostic and maintenance procedures much less time consuming and more efficient. Thus, the high-voltage connection enclosure provides a consistent, reliable and high quality, high-voltage electrical connection between ends of GTO cables.

While the present invention has been illustrated by a description of various described embodiments and while these embodiments have been described in considerable detail, it is not the intention of Applicant to restrict or in any way limit the scope of the appended claims to such detail. Additional advantages and modifications within the spirit and scope of the invention will readily appear to those skilled in the art. For example, in the described embodiment, the tubular body 28 is described as a generally cylindrical body which has a generally circular cross-sectional shape. As will be appreciated, the tubular body 28 may have any cross-sectional shape, for example, noncircular or multilateral. Further, the tubular body is described as being secured by a spring clamp 30; however, as will be appreciated, the tubular body may be secured to the mounting base 22 by other means, for example, a threaded connection. Further, the tube clamp 30 may be made from a metal, plastic or other material that provides the necessary function. In addition, as will be appreciated, in the assembly of the tubular body 28 onto the mounting base 22, it may be desirable to mounted the end 106 of the tubular body 28 against an O-ring located over the circular mount 46 and against the forward surface 108.

Further, in the described embodiment, the separator 66 is secured to the mounting base 22 by resilient fingers 88 to form a unitary structure with the mounting base. While a plurality of circumferentially arranged fingers 88 is described, a single or any number of fingers may be used. In addition, as will be appreciated, instead of using the fingers 88, the separator 26 may be connected to the mounting base 22 by adhesives, welding, threads or other means. Alternatively, the mounting base 22 and separator 26 may be manufactured as a single unitary structure.

The description of the tubular body 28 as being clear glass means that the tubular body is sufficiently translucent or transparent so that the electrical connection may be visually inspected through the cover. Alternatively, the tubular body may also be opaque although the advantage of visual inspection will be lost. As will be further appreciated, even though glass has excellent long term electrically insulation properties, the tubular body 28 may be made of other electrically nonconductive materials.

Therefore, the invention in its broadest aspects is not limited to the specific detail shown and described. Consequently, departures may be made from the details described herein without departing from the spirit and scope of the claims which follow.

What is claimed is:

1. An apparatus for enclosing an electrical connection between first and second high-voltage cables comprising:

a mounting base;

an electrically nonconductive tubular cover having an open end releasably attachable to the mounting base and a closed end; and an electrically nonconductive separator adapted to receive the high-voltage cables, the separator comprising one end integral with the mounting base, a distal end extending outward from the mounting base inside the tubular cover and toward the closed end of the cover, and opposed sides extending between the ends of the separator, each of the high-voltage cables adapted to be disposed along a different one of the opposed sides of the separator.

2. The apparatus of claim 1 wherein the distal end of the separator is disposed closer to the closed end of the tubular cover than the open end, and the separator has a length about equal to a desired spacing separating the electrical connection between the high-voltage cables and an electrical conductor associated with the mounting base.

3. The apparatus of claim 1 wherein the separator comprises a base portion with first and second passages receiving the first and second high-voltage cables, respectively.

4. The apparatus of claim 3 wherein the separator further comprises a spacer wall extending from the base portion, the spacer wall having a first side portion along which the first high-voltage cable is disposed and a second side portion along which the second high-voltage cable is disposed.

5. The apparatus of claim 1 wherein the mounting base comprises a hole and the separator comprises a base portion mounted in the hole in the mounting base.

6. The apparatus of claim 5 wherein the base portion of the separator comprises a fixed member and a resiliently mounted member for mounting the separator in the mounting base.

7. The apparatus of claim 6 wherein the fixed member comprises a retaining lip on one end of the separator, the retaining lip preventing the one end of the separator from entering the hole in the mounting base.

8. The apparatus of claim 7 wherein the resiliently mounted member comprises a finger axially displaced from the retaining lip, the finger moving inward upon being forced into one end of the hole in the mounting base and the finger moving outward upon leaving an opposite end of the hole in the mounting base and latching onto the opposite end of the mounting base.

9. The apparatus of claim 6 wherein the resiliently mounted member comprises at least two opposed fingers.

10. The apparatus of claim 9 wherein the cover extends over and compresses the two opposed fingers, thereby moving each of the two opposed fingers into contact with a separate one of the first and second high-voltage cables.

11. The apparatus of claim 6 wherein the resiliently mounted member comprises a plurality of fingers mounted in a circular arrangement around the separator.

12. The apparatus of claim 11 wherein each of the plurality of fingers is separated from an adjacent finger by a slot.

13. The apparatus of claim 12 wherein each of the plurality of fingers is cantilevered from the fixed member.

14. The apparatus of claim 1 wherein the mounting base comprises first and second cavities, each of the first and second cavities adapted to receive one of the first and second conduits carrying the first and second high-voltage cables, respectively.

15. The apparatus of claim 14 wherein the mounting base further comprises a bracket releasably mounted to the mounting base for clamping the first and second conduits to the mounting base.

16. The apparatus of claim 15 wherein the bracket comprises first and second ears for engaging outer portions of the respective first and second conduits.

17. The apparatus of claim 1 wherein the electrically nonconductive cover comprises an electrically nonconductive tubular body having a closed end and an open end, and the mounting base has a mount releasably connecting to the open end of the tubular body.

18. The apparatus of claim 17 wherein the electrically nonconductive tubular body is a substantially cylindrical tubular body.

19. The apparatus of claim 17 wherein the mounting base has a hole extending through the mount and the separator has a base portion extending through the hole in the mount.

20. The apparatus of claim 1 wherein the mounting base is made from an electrically conductive material.

21. The apparatus of claim 1 wherein the tubular cover is sufficiently transparent to permit the electrical connection joining the high-voltage cables to be visually inspected through the translucent cover.

22. The apparatus of claim 21 wherein the tubular cover is a clear glass cover.

23. An apparatus for enclosing an electrical connection between first and second high-voltage cables comprising:

a mounting base:

an electrically nonconductive separator having first and second passages adapted to receive the first and second high-voltage cables, respectively, and at least two fingers resiliently mounted on the separator, each of the fingers extending toward a separate one of the first and second passages; and an electrically nonconductive tubular cover extending over the electrical connection and the high-voltage cables, the two fingers and being releasably mountable to the mounting base, the cover depressing the two fingers toward the high-voltage cables and moving each of the fingers into contact with a separate one of the high-voltage cables to secure the high-voltage cables in the mounting base.

24. An apparatus for enclosing an electrical connection between first and second high-voltage cables being carried in respective first and second conduits comprising:

a mounting base having a cavity adapted to receive the first and second conduits;

an electrically nonconductive separator having a base portion forming a unitary structure with the mounting base, first and second passages in the base portion of the separator and contiguous with the cavity in the mounting base, each of the passages adapted to receive a separate one of the high-voltage cables, a spacer wall extending from the base portion and having opposite sides, each of the high-voltage cables being disposed along a different opposite side of the spacer wall, a distal end extending from the mounting base and beyond which the high-voltage cables are connected, the distal end defining a separator length about equal to a desired spacing between an electrical connection of the high-voltage cables and an electrical conductor associated with the mounting base; and a transparent glass cover extending over the electrical connection, the high-voltage cables and the separator, the transparent glass cover being releasably mountable to the mounting base.

25. The apparatus of claim 24 wherein the separator further comprises at least two opposed fingers for securing the separator in the mounting base.

26. The apparatus of claim 24 wherein the transparent glass cover extends over the two fingers and depresses and moves each of the fingers into contact with a separate one of the high-voltage cables to secure the high-voltage cables in the mounting base.

27. A method of electrically connecting two high-voltage cables comprising:

inserting each of the high-voltage cables into a separate passage formed of a nonconductive material integral with a mounting base;

extending each of the high-voltage cables along a different side of an electrically nonconductive separator that extends a distance beyond the mounting base about equal to a desired separation between an electrical connection between the cables and an electrical conductor associated with the mounting base;

joining the ends of the high-voltage cables together to form the electrical connection; and placing an electrically nonconductive tubular cover over the electrical connection and the high voltage cables; and releasably attaching the electrically nonconductive tubular cover to the mounting base.

28. The method of claim 27 further comprising extending each of the high-voltage cables along opposite sides of an electrically nonconductive spacer wall a desired distance.

29. The method of claim 28 further comprising extending each of the high-voltage cables along an electrically nonconductive spacer wall having one end fixed to the mounting base at a location between passages carrying the high-voltage cables.

30. The method of claim 27 further comprising covering the electrical connection and the electrically nonconductive member with a translucent cover permitting the electrical connection to be visually inspected through the cover.

31. The method of claim 27 further comprising covering the electrical connection and the electrically nonconductive member with a clear glass cover.

32. The method of claim 27 further comprising securing the high-voltage cables in the mounting base.

33. The method of claim 32 further comprising securing the high-voltage cables in the mounting base simultaneously with placing the electrically nonconductive tubular cover over the electrical connection and the high voltage cables.

34. The method of claim 32 further comprising:

sliding the electrically nonconductive tubular cover over a plurality of resilient teeth; and pushing one of the resilient teeth against a separate one of each of the high-voltage cables.

35. The method of claim 27 further comprising attaching the mounting base to a wall of a structure with a closed end of the tubular cover directed in an upward direction.

* * * * *